US011584153B2

(12) United States Patent
Iwai et al.

(10) Patent No.: US 11,584,153 B2
(45) Date of Patent: Feb. 21, 2023

(54) PAINTING PANEL

(71) Applicants: Kikuko Iwai, Chiba (JP); Kie Iwai, Chiba (JP)

(72) Inventors: Kikuko Iwai, Chiba (JP); Kie Iwai, Chiba (JP)

( * ) Notice: Subject to any disclaimer, the term of this patent is extended or adjusted under 35 U.S.C. 154(b) by 644 days.

(21) Appl. No.: 16/668,612

(22) Filed: Oct. 30, 2019

(65) Prior Publication Data

US 2020/0139752 A1 May 7, 2020

(30) Foreign Application Priority Data

Nov. 1, 2018 (JP) ..... JP2018-206917
Nov. 1, 2018 (JP) ..... JP2018-206919

(51) Int. Cl.
*B44D 3/18* (2006.01)

(52) U.S. Cl.
CPC ..... *B44D 3/185* (2013.01)

(58) Field of Classification Search
CPC ... D04H 5/04; D04H 1/58; D04H 3/12; B29C 70/081; B32B 5/022; B32B 5/26; B32B 29/002; B32B 2250/20; B32B 2260/028; B32B 2260/046; B32B 2262/02; B32B 2262/067; B32B 2262/101; B32B 2262/14; B32B 2264/02; B32B 2307/3065; B32B 2307/536; B32B 2307/546; B32B 2307/7265; B32B 2307/732; B32B 2307/734; B32B 2419/00; B32B 2607/00; B32B 5/265; B32B 7/12; B32B 29/04; B32B 3/263; B32B 5/02; B32B 5/024; B32B 5/16; B32B 5/262; B32B 7/022; B32B 29/02; B44D 3/18; B44D 3/185
See application file for complete search history.

(56) References Cited

U.S. PATENT DOCUMENTS

| | | | | |
|---|---|---|---|---|
| 3,096,194 | A | 7/1963 | Klimann | |
| 4,065,596 | A | 12/1977 | Groody | |
| 7,476,436 | B2 | 1/2009 | Armstrong et al. | |
| 2007/0122616 | A1* | 5/2007 | Lawson | B32B 5/12 428/375 |
| 2019/0000676 | A1* | 1/2019 | Shirai | A61F 13/0256 |

FOREIGN PATENT DOCUMENTS

JP 2007-313746 A 12/2007

OTHER PUBLICATIONS

Extended European Search Report issued for the counterpart European Patent Application No. 19205089.6 dated Mar. 20, 2020.

* cited by examiner

*Primary Examiner* — Brian Handville
(74) *Attorney, Agent, or Firm* — IP Business Solutions, LLC

(57) ABSTRACT

A painting panels capable of maintaining planarity of a canvas without being subject to an aging, which may happen often in wooden frames is provided. A painting panel in which a covering member including a plurality of layers made of neutral paper is stretched and secured over an outer surface of a grid framework formed by assembling squared bars made of at least one selected from cedar, Japanese cypress, Maki, *paulownia*, ash, beech, *zelkova*, oak, cherry, and teak into a grid shape.

12 Claims, 5 Drawing Sheets

[Fig. 1]
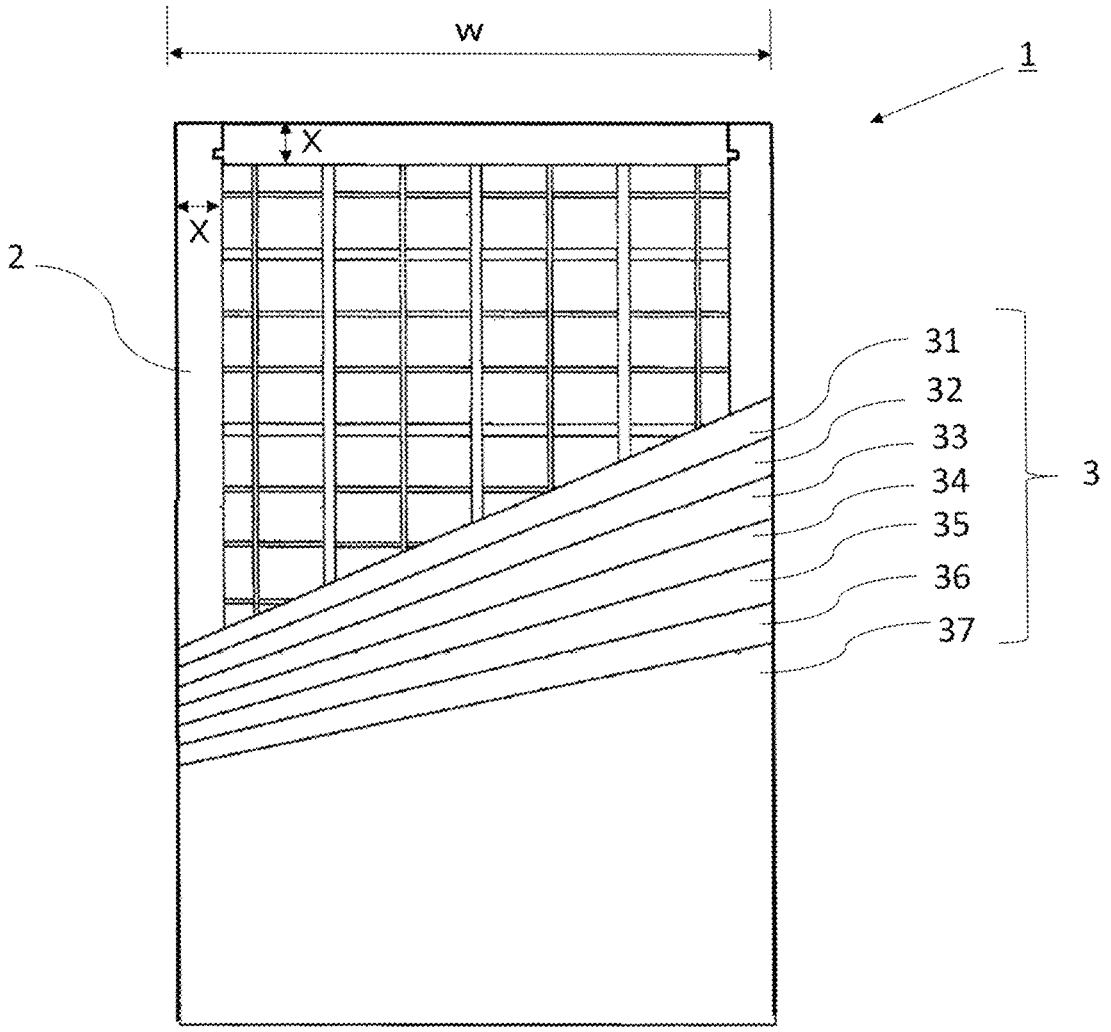

[Fig. 2]
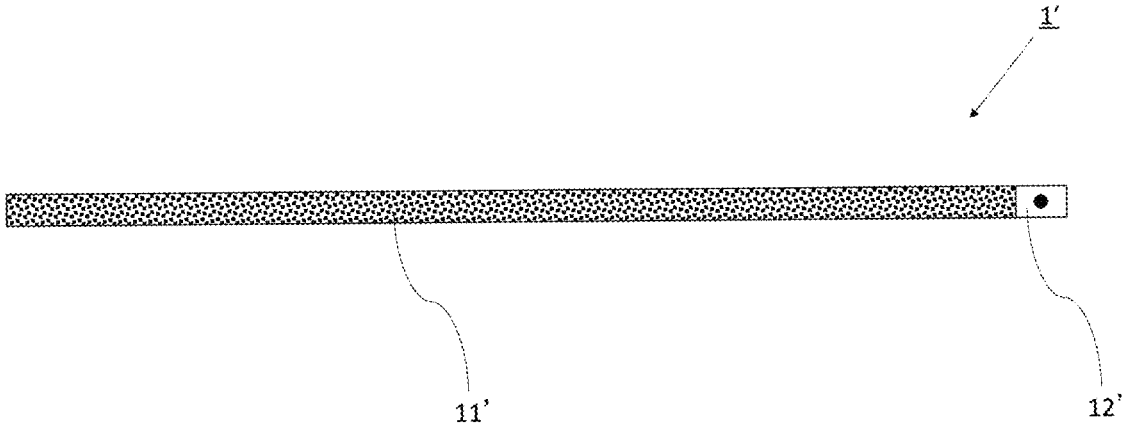

[Fig. 3]
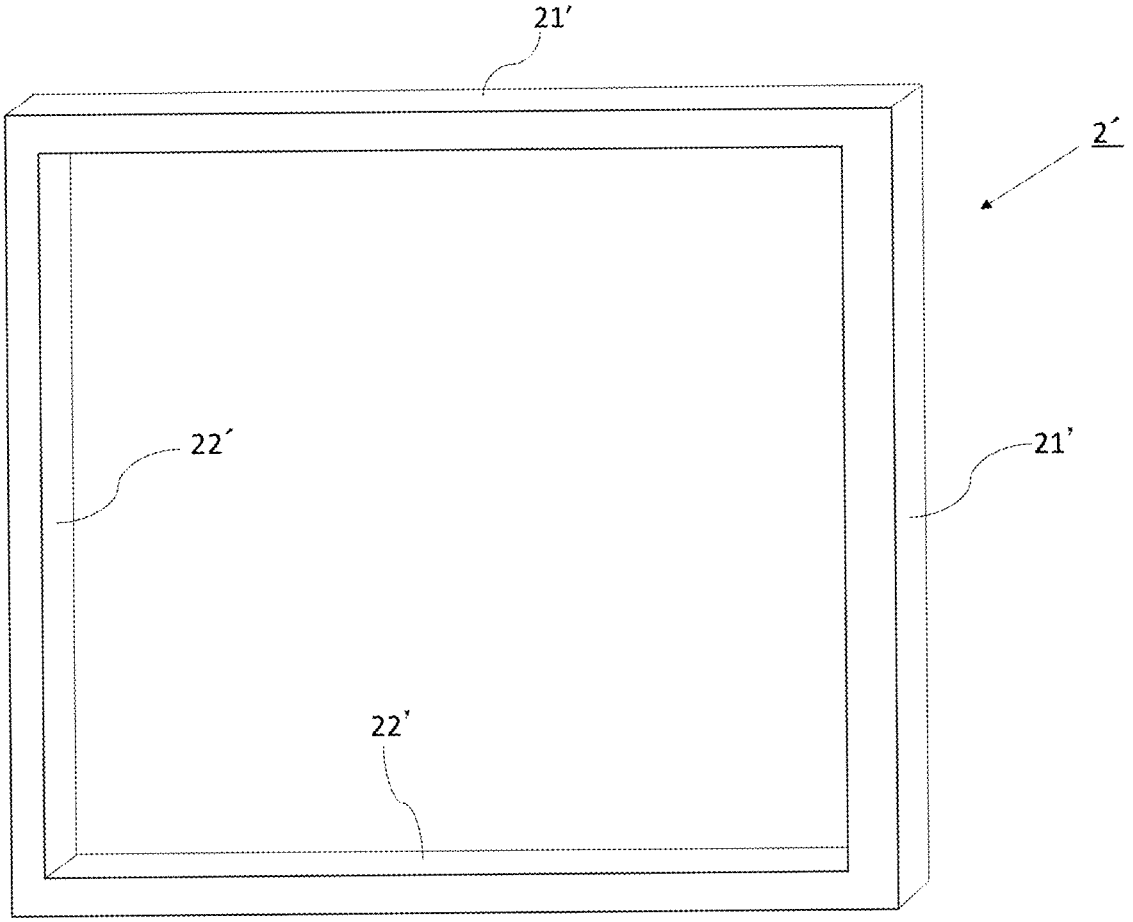

[Fig. 4]
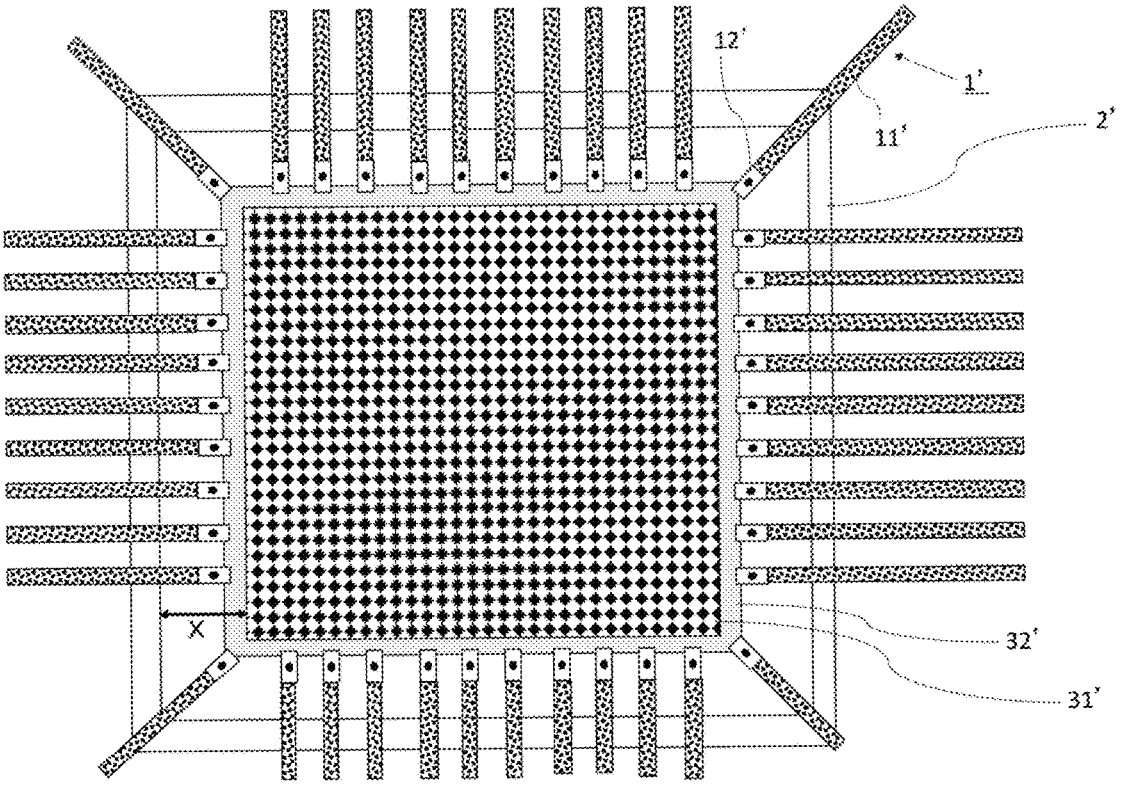
[Fig. 5]
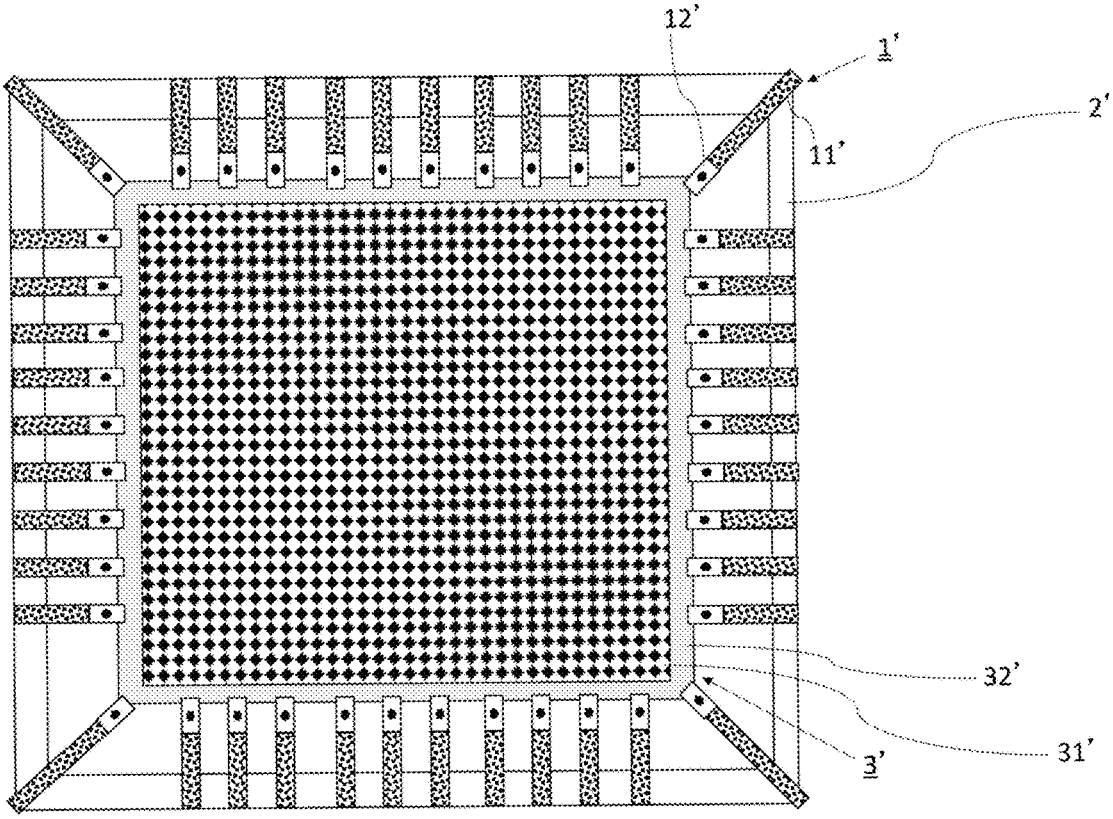

[Fig. 6]
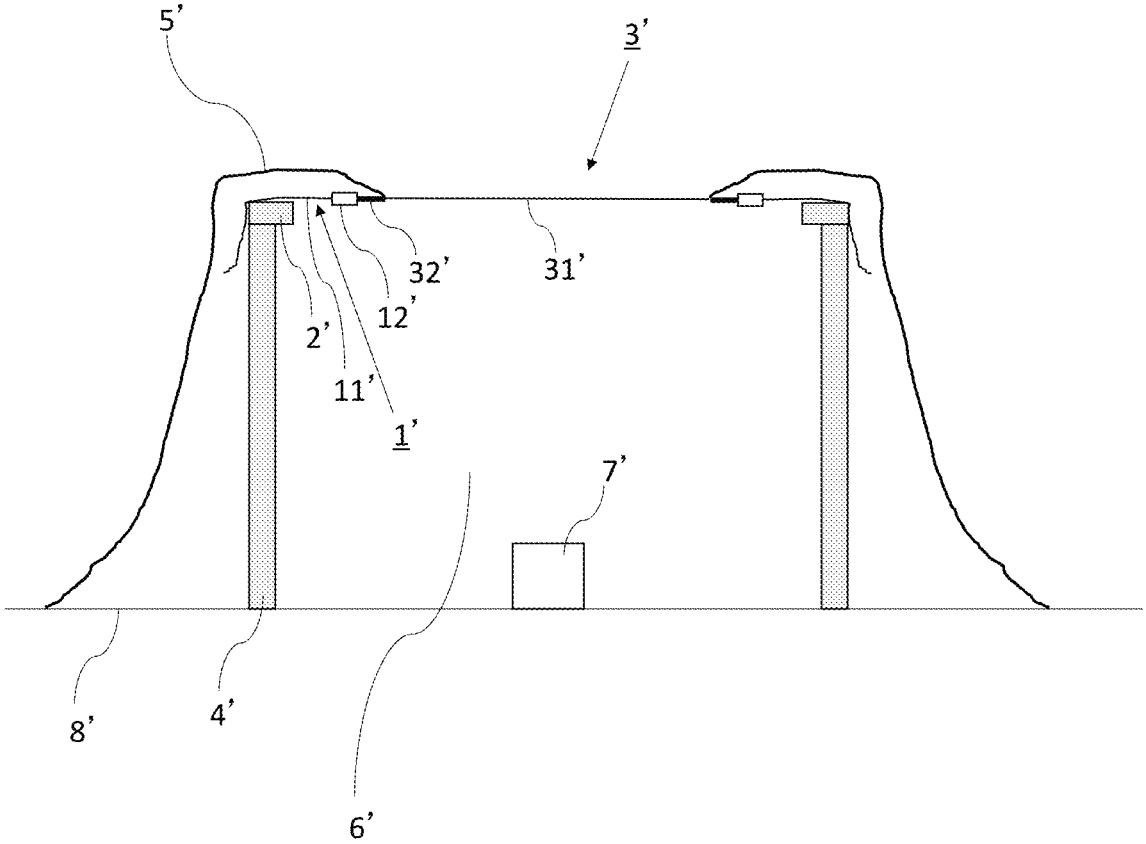

PAINTING PANEL

FIELD OF INVENTION

The present invention relates to a painting panel.

BACKGROUND OF THE INVENTION

Typically, an oil painting is composed of a sealing layer, a primer layer, a painting layer, and a varnish layer superimposed in this order on a support member of a canvas such as a linen cloth.

A so-called stretched canvas formed by stretching and securing a canvas over a wooden frame assembled into a frame shape (PTL 1, for example) is used as the support member in many cases.

However, the canvas stretched and secured over the wooden frame has a disadvantage in that the wooden frame is deformed due to an aging and planarity of the canvas is impaired, and at the same time, a paint layer is damaged.

Since a painter paint a painting on a plane of a taut canvas, impairment of planarity of the canvas leads to impairment of intension of the painter, which may results in an impairment of the value of the painting.

CITATION LIST

Patent Literature

PTL 1: JP 2007-313746 A

SUMMARY OF THE INVENTION

Technical Problem

In view of such problems, it is an object of the present invention to solve the problems of the related art and to provide a painting panel capable of maintaining planarity of a canvas for a long time without being subject to an aging, which may happen often in wooden frames.

Solution to Problem

The present invention provides the following [1] to [6].

[1] A painting panel including: a covering member; and a grid framework, the covering member having a plurality of layers made of neutral paper, the grid framework being formed by assembling squared bars made of at least one selected from cedar, Japanese cypress, Maki (*Sciadopitys verticillata*), *paulownia*, ash, beech, *zelkova*, oak, cherry, and teak into a grid pattern, the covering member being stretched and secured over an outer surface of the grid framework.

[2] The painting panel according to [1], in which the neutral paper is Japanese paper which is made from Kozo (*Broussonetia kazinoki*×*B. papyrifera*) fibers.

[3] The painting panel according to [1] or [2], in which the squared bars are formed by processing a sapwood of a cedar material.

[4] The painting panel of any one of [1] to [3], in which the grid framework has an outer frame having a front width X of at least 18 mm, and a lateral side width Y of 13 to 30 mm.

[5] The painting panel according to any one of [1] to [4], in which the covering member includes, in order from the grid framework side, a honeshibari layer, a doubari layer, a minobari layer, a minoshibari layer, a shitabukuro layer, an uwabukuro layer, and a kyoubari layer.

[6] The painting panel according to [5], in which the partly overlapping layer is at least one of a double partly overlapping layer and a triple partly overlapping layer.

Advantageous Effects of Invention

According to the present invention, a painting panel capable of maintaining the planarity of the canvas for a long time without being subject to an aging, which may happen often in wooden frames.

BRIEF DESCRIPTION OF DRAWINGS

FIG. 1 is a front view of a painting panel in a partially cutaway state according to an embodiment of the present invention.

FIG. 2 is a top view of a holding belt used in an embodiment of the method of restoring a painting of the following [7] to [11].

FIG. 3 is an overall perspective view of a frame body used in the embodiment of the method of restoring a painting of the following [7] to [11].

FIG. 4 is an explanatory view for an arrangement step according to the embodiment of the method of restoring a painting of the following [7] to [11].

FIG. 5 is an explanatory view for a sticking step according to the embodiment of the method of restoring a painting of the following [7] to [11].

FIG. 6 is an explanatory view for a step of increasing humidity according to the embodiment of the method of restoring a painting of the following [7] to [11].

DETAILED DESCRIPTION OF THE INVENTION

A painting surface protection structure for a painting according to an embodiment of the present invention will now be described in detail. However, the present invention is not limited to the following embodiments.

As illustrated in FIG. 1, a painting panel 1 includes a grid framework 2 and a covering member 3 which is stretched and secured over an outer surface of the grid framework 2. As used herein the term "stretched and secured over" means to extend a material in a taut state under tension and secure the same.

The covering member 3 is composed of a plurality of layers made of neutral paper, preferably Japanese paper.

As used herein the term neutral paper means a paper having PH 6.5 TO PH 10. As the neutral paper, for example, protective paper manufactured by TT Trading Co., Ltd. can be used.

As used herein the term "Japanese paper" means a neutral Japanese paper obtained by traditional techniques handed down from ancient times in Japan and which are made from fibers extracted directly from plants such as Kozo.

Japanese paper has a property of being neutral because it is made almost without use of chemicals. Japanese paper is made of long plant fibers entangled and bonded to each other to form a sheet, and also has a property of excellent air permeability with the presence of a number of gaps, which can be observed with a microscope.

Preferably, the covering members 3 having the same layer structure are stretched and secured over both surfaces, i.e., a front surface and a back surface, of the grid framework 2. This can avoid warping of the painting panel 1 which may impair the planarity.

The grid framework 2 may be formed of a squared bars made of at least one selected from cedar, Japanese cypress, Maki, *paulownia*, ash, beech, *zelkova*, oak, cherry, and teak and can be constructed by assembling them in a grid shape. Preferably, tightening of the grid framework 2 is performed from Kamachi (frame) by using bamboo nails or hollow chips.

Preferably, the squared bars which constitute the grid framework 2 are made of a wooden material containing less resin, being lightweights, and having an excellent workability, and is preferably obtained by processing sapwood of cedar material.

As used herein the term "sapwood of cedar material" means a part located at the outer peripheral part with respect to a heartwood (reddish body, reddish part), which is located at a center part of the cedar material. In other words, the sapwood of cedar material is a part having a light color located at the outer peripheral part of a trunk and being referred also to as alburnum. Since the sapwood typically contains less resin than the heartwood (reddish body, reddish part), a problem of contamination of the painting due to the resin is effectively avoided.

By configuring the squared bars cut out from the alburnum of the Japanese cedar containing less resin so as to face the straight grain forward, the risk of distortion or contamination of the painting due to penetration of the resin into the painting panel 1 due to an aging can be avoided.

The painting panel 1 of the present invention in which the covering member having a plurality of layers made of neutral paper is stretched and secured over the outer surface of the grid framework made of squared bars of cedar or the like have properties of being neutral, being lightweight and superior in air permeability, and being capable of maintaining planarity of the surface semi-permanently.

By using the neutral painting panel 1 instead of a wooden frame of the related art and using a wooden frame with a canvas stretched and secured as a support member for oil painting, progress of deterioration due to oxidation in the canvas and in the painting layer constituting the oil painting is suppressed.

By using the painting panel 1 having excellent air permeability instead of the wooden frame of the related art and using the wooden frame with a canvas stretched and secured as the support member for oil painting, expansion and contraction of the back surface of the canvas and generation of mold due to moisture is suppressed.

By using the painting panel 1 capable of maintaining the planarity of the surface semi-permanently instead of the wooden frame of the related art and using the wooden frame with a canvas stretched and secured as the support member for oil painting, the planarity of the canvas can be maintained desirably and semi-permanently, so that the painting layer can be kept healthy.

The Japanese paper is preferably made of fibers obtained from plants, and examples thereof include Mino paper, Sekishu paper, Hosokawa paper, and Ganpi paper.

Examples of the plant include a combination of one or two or more kinds selected from the group consisting of Kozo, Mitsumata (*Edgeworthia chrysantha*), Ganpi, hemp, cotton, bamboo, straw, trees, kenaf, and vegetation.

For the application of the present invention, it is particularly preferable to use a handmade Japanese paper made from Kozo. The handmade Japanese paper made from Kozo contains long fibers and has properties of being tearing-resistant and tough, and thus is also used for lining for repair.

As illustrated in FIG. 1, the covering member 3 in the present embodiment has, in order from the side facing the grid framework 2, "a honeshibari layer" (a framework binding layer) 31, "a doubari layer" (a reinforcing thick layer) 32, "a minobari layer" (a partly overlapping layer) 33, "a minoshibari layer" (an overlap binding layer) 34, "a shitabukuro layer" (a lower bag-like layer) 35, "a uwabukuro layer" (an upper bag-like layer) 36, and "a kyoubari layer" (a top layer) 37.

The honeshibari layer 31 is a layer of Japanese paper pasted to the grid framework 2. The honeshibari layer 31 is made of a Japanese paper having strong fibers and has a function of tightening the grid framework 2 so as to prevent rattling or the like.

The doubari layer 32 is a layer of Japanese paper pasted to the honeshibari layer 31. The r doubari layer 32 has a function of preventing the grid framework 2 from being seen through the front surface, and a function of enhancing framework binding of the honeshibari layer 31.

The minobari layer 33 is a layer of Japanese paper pasted to the doubari layer 32. The minobari layer 33 is made of several pieces of thin handmade Japanese paper and is formed by a method of piling the pieces of Japanese paper in a state of being shifted by a prescribed width and pasting to each other like a Japanese traditional straw raincoat, which provides a cushioning function. The present invention is preferably applied to at least one of the double partly overlapping layer made by pasting two pieces of thin handmade Japanese paper in pile or a triple partly overlapping layer made by pasting three pieces of thin handmade Japanese paper in pile, and the triple partly overlapping layer is particularly preferred.

The minoshibari layer 34 is a layer of Japanese paper pasted to the minobari layer 33. The minoshibari layer 34 has a function to fix the minobari layer 33.

The l shitabukuro layer 35 is a layer of Japanese paper pasted to the o minoshibari layer 34. The u uwabukuro layer 36 is a layer of Japanese paper pasted to the l shitabukuro layer 35. The uwabukuro layer 36 and the shitabukuro layer 35 are each made of a thin handmade Japanese paper, is formed by a method of applying glue thinly only along the outer periphery of the paper and pasting the paper to a bag shape. The Japanese paper formed into a bag shape provides a soft texture of true Japanese Paper.

The kyoubari layer 37 is a layer of Japanese paper pasted to the uwabukuro layer 36. The kyoubari layer 37 becomes the surface of the painting panel 1.

Although the front width (X in FIG. 1) of an outer frame of the grid framework 2 and the lateral side width (width Y when viewed from the front) can be adjusted according to the characteristics of the workpiece, it is preferable to satisfy the following conditions because the canvas for oil painting is used by being stretched and secured with nails. Hereinafter, nail (s) for the canvas is referred to as "tack(s)", and a needle(s) to be driven by a gun tacker is referred to as "staple(s)".

The canvas can be stretched and secured over the painting panel 1 stably by having a front width X of at least X' mm+8 mm assuming that the length of the tacks or the staples is "X' mm", and having a lateral side width Y of at least Y'+3 mm assuming that the length of the tacks or the staples is "Y' mm", so that cracking of the grid framework 2 is prevented. The length of the tacks or staples is usually 10 mm.

The front width X is preferably as wide as possible. The front width X is preferably X'+8 mm to 10 mm, more preferably X'+8 mm to 20 mm, and still more preferably X'+8 mm to 40 mm.

The narrower the lateral side width Y, the easier the insertion into the frame. The lateral side width Y is preferably Y'+3 mm to 20 mm, more preferably Y'+7 mm to 15 mm, and still more preferably Y'+8 mm to 10 mm. By limiting the lateral side width Y up to Y' mm+20 mm, the painting panel 1 can be accommodated in various types of frames.

The work of stretching and securing the canvas for oil painting over the painting panel 1 of the present invention can be achieved by using a mallet and tacks or by using a gun tacker and staples in the same manner as the work of stretching and securing over the wooden frame under tension of the related art.

The tacks or staples are usually driven into an outer surface or an inner surface of the outer frame of the grid framework 2.

When the canvas to be stretched and secured over the painting panel 1 is a canvas after the painting layer is repaired, the tacks and staples are driven into a separate cloth adhered as a strip lining. As used herein the term "strip lining" means a method of reinforcing an outer edge of the canvas by pasting a separate cloth to an outer edge of the canvas.

As used herein the term "outer edge of the canvas" means a portion which does not have a paint layer and is bent and fixed to the wooden frame by iron nails or the like for canvas. In the outer edge of the canvas, as described above, since the deterioration due to oxidation progresses easily because of the absence of the painting layer, and since the canvas is bent and fixed to the wooden frame by the iron nails or the like, the outer edge is easily damaged, and the symptoms such as tearing and piercing easily occur.

In the case of driving tacks or staples into a cloth portion adhered by strip lining, the tacks and staples are driven into an inner side surface of the outer frame on the back side of the painting panel 1.

More preferably, the grid structure 2 has an outer frame having a front width (X in FIG. 1) of 5% to 8% of the width (W in FIG. 1) of the grid framework 2.

The front width (X in FIG. 1) of the outer frame set to 5% to 8% of the lateral width (W in FIG. 1) of the grid framework 2 ensures the planarity of the canvas stably regardless of the size of the canvas.

According to the present invention having a configuration described above, a painting panel capable of maintaining the planarity of the canvas for a long time without being subject to an aging, which may happen often in wooden frames is provided.

By using the painting panel of the present invention with the canvas stretched thereover, progression of deterioration due to oxidation in the canvas and picture layer can be suppressed, generation of mold on the back surface of the canvas can be suppressed, and desirable planarity of the canvas and a painting layer can be maintained semi-permanently.

It is preferable that the canvas used by being attached to the painting panel of the present invention is one in which distortion and sagging are eliminated and the flatness of the screen is restored.

For example, it is possible to eliminate distortion and sagging in the canvas and to recover planarity of the painting surface with method of restoring a painting of the following [7] to [11].

[7] A method of restoring a painting including a step of attaching holding belts each having a belt-shaped member formed of a hook-and-loop fastener and a holding member for holding a canvas to outer edges of the canvas (hereinafter referred to also as an attachment step), a step of arranging the canvas to which the holding belts are attached in a space of a frame body having the space in which the canvas can be arranged (hereinafter referred to also as an arrangement step), a step of sticking the holding belts on the frame body (hereinafter referred to also as a sticking step), a step of covering the frame body with a low-gas permeable sheet material to form a closed space under the frame body and increasing humidity by humidifying the closed space to reach a peak humidity of 80% RH or more (hereinafter referred to also as a step of increasing humidity), a step of stopping humidification after reaching the peak humidity and leaving the canvas as it is in the closed space for two hours or more while finely adjusting sticking positions of the holding belts (hereinafter referred to also as a step of being left as it is), and a step of removing the sheet material and naturally drying the canvas for six hours or more in a state where the sticking positions of the holding belts are held at positions after the fine adjustment (hereinafter referred to also as a natural drying step).

[8] The method of restoring the painting according to [7], in which the frame body has a sticking part on which the hook-and-loop fasteners are stuck, and the holding belts are stuck on the sticking part.

[9] The method of restoring the painting according to [8], in which the sticking part is formed so that a hook-and-loop fastener is stuck on at least any of an inner surface and an outer surface of the frame body.

[10] The method of restoring the painting according to any of [7] to [9], in which the holding belts are stuck in the sticking step so that positions where the holding belts are stuck on the sticking part are adjusted to positions suitable for eliminating distortion in the canvas.

[11] The method of restoring the painting according to any of [7] to [10], the step of increasing humidity, the step of being left as it is and the natural drying step are repeated until distortion and sagging in the canvas are eliminated.

Hereinafter, the painting restoration methods of the above [7] to [11] will be described.

<Preparation Step>

Strip lining is performed to outer edge portions of a canvas removed from a wooden frame according to need.

In the specification, outer edges of the canvas indicate portions not having the painting layer, being folded and fixed to the wooden frame by iron nails and the like for the canvas.

The outer edges of the canvas are highly oxidized as there is no painting layer as described above, and are easily damaged as the edges are folded and fixed to the wooden frame by the iron nails and the like; therefore, symptoms such as tearing and holes tend to occur. The strip lining means a treatment method of reinforcing outer edges of the canvas by sticking another cloth on the outer edges of the canvas.

<Attachment Step>

In this step, the work of attaching holding belts to outer edges (hereinafter referred to as outer edges 32' of the canvas or the like) of the canvas or outer edges of the cloth stuck by the strip lining is performed.

Each holding belt 1' includes a belt-shaped member 11' and a holding member 12' provided at one end of the belt-shaped member and holding the outer edges 32' of the canvas or the like as shown in FIG. 2.

The belt-shaped member 11' is formed of a hook-and-loop fastener. The hook-and-loop fastener is preferably has engaging elements on both a front surface and a rear surface. As the hook-and-loop fastener, hook-and-loop fasteners known as trade names "Magic Tape (registered trademark)" and "Velcro (registered trademark)", or a plastic molding hook-and-loop fastener made of resin can be used.

The holding member 12' is not particularly limited as far as the member can be attached to the outer edge 32' of the canvas or the like. For example, it is possible to attach the holding belt 1' by using a member in which two wooden pieces are screwed by a wing bolt so as to open/close freely and sandwiching the outer edge 32' of the canvas or the like between the two wooden pieces.

The holding belts 1' have a function of equally dispersing a force added to the canvas to upper, lower, left and right four directions.

The holding members 12' are preferably attached to the outer edges 32' of the canvas or the like at upper and lower symmetrical positions and left and right symmetrical positions.

The smaller intervals at which the holding members 12' are attached (intervals between adjacent holding members 12') are, the more effective the above function can be obtained; however, the optimum intervals can be set appropriately in consideration of flexibility of the canvas, the thickness of the canvas and the size of the canvas. It is preferable to attach the holding members 12' at intervals of 3 to 5 cm in general.

<Arrangement Step>

In this step, a frame body 2' having a space at the center shown in, for example, FIG. 3 is used. As shown in FIG. 4, a canvas 3' to which the holding belts 1' are attached is arranged in the space at the center of the frame body 2'.

The arrangement is preferably performed with adjustment so that a distance (X) between an outer periphery of a portion seen from the front in a state of being stretched on the wooden frame as an oil painting (namely, a painting surface) 31' and an inner periphery of the wooden frame is 20 to 30 cm, and more preferably, the distance (X) is 20 to 25 cm.

It is preferable that the frame body 2' is made of wood. For example, the frame body 2' can be formed by assembling four squared timbers in a quadrilateral shape.

The frame body 2' preferably has a sticking part in which the hook-and-loop fastener is stuck on at least any of an inner surface and an outer surface. The frame body 2' used in the embodiment has a sticking part 21' in which the hook-and-loop fastener is stuck on the outer surface and a sticking part 22' in which the hook-and-loop fastener is stuck on the inner surface as shown in FIG. 3.

The hook-and-loop fasteners forming the sticking parts 21', 22' preferably have engaging elements capable of being engaged with engaging elements of the hook-and-loop fasteners forming the belt-shaped members 11' of the holding belts 1'. Specifically, in a case where engaging elements of the hook-and-loop fasteners forming the belt-shaped members 11' of the holding belts 1' are hook-shaped engaging elements, the hook-and-loop fasteners forming the sticking parts 21', 22' preferably have loop-shaped engaging elements, in a case where engaging elements of the hook-and-loop fasteners forming the belt-shaped members 11' of the holding belts 1' are loop-shaped engaging elements, the hook-and-loop fasteners forming the sticking parts 21', 22' preferably have hook-shaped engaging elements, and in a case where engaging elements of the hook-and-loop fasteners forming the belt-shaped members 11' of the holding belts 1' are engaging elements in which hook-shaped engaging elements and the loop-shaped engaging elements are mixed, the hook-and-loop fasteners forming the sticking parts 21', 22' preferably have loop-shaped engaging elements and/or hook-shaped engaging elements.

<Sticking Step>

As shown in FIG. 5, in this step, the holding belts 1' attached to the canvas 3' arranged in the inner space of the frame body 2' are stuck on the frame body 2' so as to be wound thereon.

It is preferable that the sticking is performed so that sticking positions are adjusted to positions suitable for eliminating distortion and sagging in the canvas.

"To eliminate distortion and sagging in the canvas" in the specification means that waving on the surface of the canvas, uneven tension at corners and cracks generated on the painting surface are eliminated in visual observation.

As the belt-shaped members 11' of the holding belts 1' and the sticking parts 21', 22' are both formed of hook-and-loop fasteners in this embodiment, fine adjustment of sticking positions can be easily performed.

<Step of Increasing Humidity>

In this step, the canvas 3' is arranged in the inner space, and the frame body 2' in which the belt-shaped members 11' of the holding belts 1' are stuck on the sticking parts 21', 22' is placed, for example, on a leg member 4' as shown in FIG. 6, then, the frame body 2' is covered with a low-gas permeable sheet material 5' to thereby form a closed space 6' under the frame body 2'.

The closed space 6' can be formed, for example, by arranging the low-gas permeable sheet material 5' so as to cover the outer edges 32' of the canvas or the like, the holding belts 1', the frame body 2' and the leg member 4' and reach a floor surface 8' without covering the painting surface 31' of the canvas or the like.

After the closed space 6' is formed, the closed space 6' is humidified by using a humidifier 7' so that the humidity in the closed space 6' reaches a peak humidity of 80% RH or more, and preferably, 90% RH or more. Here, the peak humidity means a peak value of humidity measured at the time of humidification.

When the peak humidity is set to 80% RH or more, it is possible to give sufficient moisture to the canvas hardened due to deterioration with age (oxidization) and to recover flexibility.

The material for the sheet material 5' is not particularly limited as far as it is the low-gas permeable sheet material. For example, sheet materials made of resins such as a polyethylene resin, a nylon resin, a polypropylene resin, and a fluororesin can be cited as examples.

<Step of being Left as it Is>

In this step, humidification is stopped after reaching the peak humidity, then, the canvas is left as it is in the closed space for two hours or more while finely adjusting sticking positions between the hook-and-loop fasteners forming the sticking parts 21', 22' and the hook-and-loop fasteners forming the belt-shaped members 11' of the holding belts 1'. The canvas still contains humidity before two hours pass. As the canvas is left as it is for two hours or more, the canvas is naturally dried and becomes stable little by little. It is preferable to leave the canvas as it is for about two to five hours.

The above fine adjustment is performed for correcting distortion and sagging in the canvas. It is preferable that the fine adjustment is performed during a period until the humidity in the closed space 6' is reduced to 60% RH or less, more preferably, the fine adjustment is performed during a period until the humidity is reduced to 70% RH or less, and further more preferably, the fine adjustment is performed during a period until the humidity is reduced to 80% RH or less.

When the fine adjustment is performed under the above humidity conditions, distortion and sagging in the canvas can be corrected without applying a large load to the canvas in a state where the canvas has flexibility.

<Natural Drying Step>

In this step, after the sheet material is removed, the canvas is naturally dried for six hours or more in a state where the sticking positions between the holding belts and surfaces of the hook-and-loop fasteners are held at positions after the fine adjustment. More stable planarity can be obtained after natural drying is performed for six hours or more. It is preferable to perform drying for six to twenty-four hours.

<Repetition of Step of Increasing Humidity, Step of being Left as it is and Natural Drying Step>

In a case where distortion in the canvas is still not eliminated after the step of natural drying, the above step of increasing humidity, the step of being left as it is and the natural drying step are repeated to thereby eliminate distortion and sagging in the canvas.

The present invention having the above respective steps differs from the related-art method of lining in which the painting screen is planarized forcibly by heat and pressure, which corrects and eliminates distortion and sagging in the canvas while taking long time by using the holding belts in the state where the canvas recovers flexibility by giving humidity to the canvas; therefore, it is possible to recover planarity of the painting surface without breaking texture of the painting.

REFERENCE SIGNS LIST

1 painting panel
2 grid framework
3 covering member
31 honeshibari layer
32 doubari layer
33 minobari layer
34 minoshibari layer
35 shitabukuro layer
36 uwabukuro layer
37 kyoubari layer
1' holding belt
11' belt-shaped member
12' holding member
2' frame body
21' sticking part
22' sticking part
3' canvas
31' painting surface
32' outer edge of canvas or the like
4' leg member
5' sheet material
6' closed space
7' humidifier
8' floor surface

The invention claimed is:

1. A painting panel comprising:
a covering member; and
a grid framework,
wherein the covering member has a plurality of layers made of neutral paper,
the grid framework is formed by assembling squared bars made of at least one selected from cedar, Japanese cypress, Maki, *paulownia*, ash, beech, *zelkova*, oak, cherry, and teak into a grid pattern,
the covering member is stretched and secured over an outer surface of the grid framework, and
wherein the covering member includes, in order from a side facing the grid framework, a framework binding layer, a reinforcing thick layer, a partly overlapping layer, an overlap binding layer, a lower bag-like layer, an upper bag-like layer, and a top layer.

2. The painting panel according to claim 1, wherein the neutral paper is Japanese paper which is made from Kozo fibers.

3. The painting panel according to claim 1 wherein the squared bars are formed by processing a sapwood of the cedar material.

4. The painting panel according to claim 1, wherein the grid framework has an outer frame having a front width X of at least 18 mm, and a lateral side width Y of 13 to 30 mm.

5. The painting panel according to claim 1, wherein the partly overlapping layer is at least one of a double partly overlapping layer and a triple partly overlapping layer.

6. The painting panel according to claim 1, wherein the framework binding layer is made of a Japanese paper having strong fibers for tightening the grid framework.

7. The painting panel according to claim 1, wherein the reinforcing thick layer is a layer of Japanese paper pasted to the framework binding layer for preventing the grid framework from being seen through a front surface of the painting panel and enhancing framework binding of the framework binding layer.

8. The painting panel according to claim 1, wherein the partly overlapping layer is a layer of Japanese paper pasted to the reinforcing thick layer and is made of several pieces of thin handmade Japanese paper as a cushioning layer.

9. The painting panel according to claim 1, wherein the overlap binding layer is a layer of Japanese paper pasted to the partly overlapping layer, and the overlap binding layer and the partly overlapping layer are fixed.

10. The painting panel according to claim 1, wherein the lower bag-like layer is a layer of Japanese paper pasted to the overlap binding layer in a bag shape and is made of a thin handmade Japanese paper.

11. The painting panel according to claim 1, wherein the upper bag-like layer is a layer of Japanese paper pasted to the lower bag-like layer in a bag shape and is made of a thin handmade Japanese paper.

12. The painting panel according to claim 1, wherein the top layer is a layer of Japanese paper pasted to the upper bag-like layer and is a surface of the painting panel.

* * * * *